United States Patent [19]

Jamerson et al.

[11] Patent Number: 4,575,884

[45] Date of Patent: Mar. 18, 1986

[54] SLEEPING BAG SHEET INSERT

[76] Inventors: Willis B. Jamerson; George Spector, both of 233 Broadway, Rm. 3615, New York, N.Y. 10007

[21] Appl. No.: 636,130

[22] Filed: Jul. 30, 1984

[51] Int. Cl.[4] ..... A47G 9/06; A47G 9/04

[52] U.S. Cl. ..... 5/420; 5/413; 5/496

[58] Field of Search ..... 5/413, 419, 441, 417, 5/420, 418, 470, 471, 454, 496, 498, 499

[56] References Cited

U.S. PATENT DOCUMENTS

| | | | |
|---|---|---|---|
| 65,262 | 5/1967 | Ouroussoff | 5/420 |
| 795,108 | 7/1905 | Doellinger | 5/441 |
| 2,324,665 | 7/1943 | Ayers | 5/413 |
| 2,630,588 | 3/1953 | Levin | 5/496 |
| 3,689,947 | 9/1972 | Wolf | 5/419 |
| 4,128,908 | 12/1978 | Kerbs | 5/413 |
| 4,375,111 | 3/1983 | Hall | 5/420 |

FOREIGN PATENT DOCUMENTS

| | | | |
|---|---|---|---|
| 2517191 | 6/1983 | France | 5/419 |

*Primary Examiner*—Alexander Grosz

[57] ABSTRACT

A sleeping bag sheet insert is provided for fitting within a sleeping bag and for preventing inside of the sleeping bag from becoming soiled. The inserts consists of an upper layer, a lower layer and an attached pillow case formed therein for removably retaining a pillow at the head portion of the insert to prevent the pillow from being uncovered during normal use.

1 Claim, 4 Drawing Figures

SLEEPING BAG SHEET INSERT

BACKGROUND OF THE INVENTION

The instant invention relates generally to sleeping bags and more specifically it relates to a sleeping bag sheet insert having an attached pillowcase for fitting within a sleeping bag and for preventing inside of the sleeping bag from becoming soiled.

Numerous sleeping bags have been provided in prior art that are adapted to contain liners. For example U.S. Pat. Nos. 2,972,757; 4,292,700 and 4,339,835 all are illustrative of such prior art. While these units may be suitable for the particular purpose to which they address they would not be suitable for the purposes of the present invention as heretofore described.

SUMMARY OF THE INVENTION

A principal object of the present invention is to provide a sleeping bag sheet insert that has an attached pillowcase thereto.

Another object is to provide a sleeping bag sheet insert that can be fabricated quickly and easily from a single sheet of cloth.

An additional object is to provide a sleeping bag sheet insert that has a foam rubber sleeping pad and an inflatable pillow insert for additional comfort to the user of the sleeping bag.

A further object is to provide a sleeping bag sheet insert that is simple and easy to use.

A still further object is to provide a sleeping bag sheet insert that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
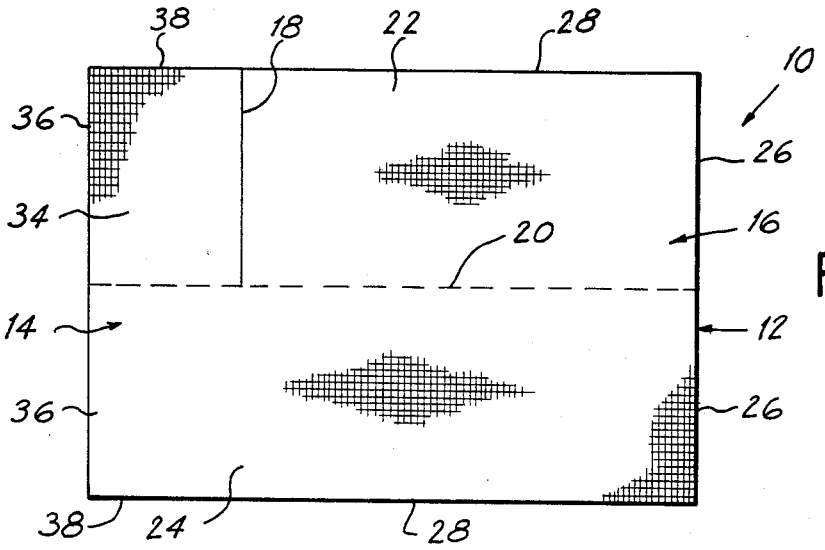
FIG. 1 is a top plan view of a sheet before fabrication.
Figure 2:
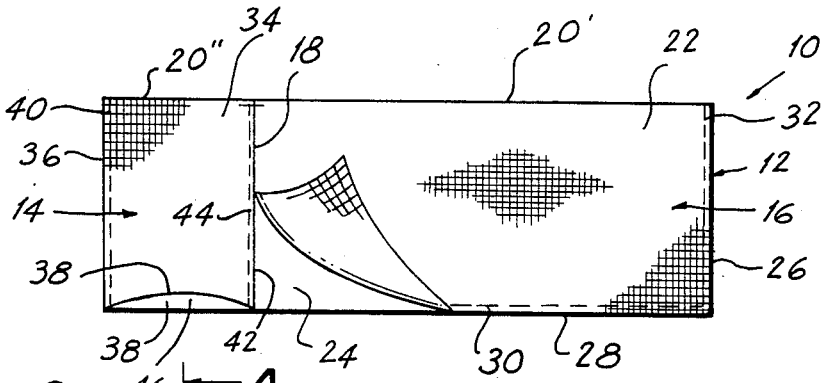
FIG. 2 is a top plan view of the invention after fabrication.

Turning now descriptively to the drawings, in which similar reference characters denote similar elements throughout the several views, FIGS. 1 and 2 illustrates a sleeping bag sheet insert 10 that consists of an elongated sheet 12 with a head portion 14 and foot portion 16. The sheet 12 is cut along a transverse line 18 in its head portion 14 to a center line 20. The sheet 12 is folded along its center line 20 below the transverse cut line 18 to form an upper panel 22 and a longer lower panel 24 with foot portion edges 26, 26 a common folded edge 20 ′ and free side edges 28, 28. The corresponding free side edges 28, 28 of the upper panel 22 and lower panel 24 are at least partially sewn together with a seam 30 and the corresponding foot portion edges 26, 26 of the upper panel 22 and lower panel 24 are sewn together with a first transverse seam 32.

The sheet 12 is further folded along its center line 20 above the transverse cut line 18 to form an upper pillow panel 34 with a common folded edge 20″, free top edges 36, 36 and free side edges 38, 38 with the lower panel 24. The corresponding free top edges 36, 36 of the upper pillow panel 34 and the lower panel 24 are sewn together with a second transverse seam 40 and the bottom edge 42 of the upper pillow panel 34 is sewn to the lower panel 24 with a third transverse seam 44 to form a pillow pocket or case 46.

Figure 3:
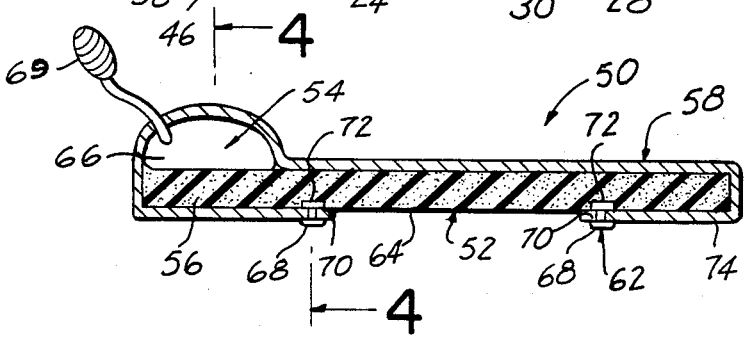
FIG. 3 is a cross sectional view of a modification showing a sheet snapped over a foam rubber sleeping pad having an inflatable pillow insert providing an assembly for convenient insertion into a sleeping bag.
Figure 4:
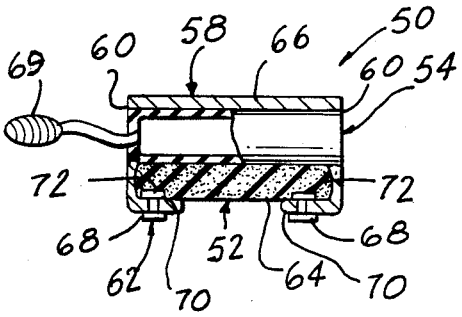
FIG. 4 is a cross sectional view taken along line 4—4 in FIG. 3.

FIGS. 3 and 4 show a sleeping bag sheet insert 50 for fitting within a sleeping bag (not shown) and for preventing inside of the sleeping bag from becoming soiled. The insert 50 consists of a foam rubber sleeping pad 52, an inflatable pillow insert 54 placed on the head portion 56 of the sleeping pad 52 and an elongated sheet 58 to cover the sleeping pad 52 and the pillow insert 54. The sheet 58 is open on sides 60, 60 over the pillow insert 54 so that the pillow insert 54 can be removed therefrom. An attachment device 62 is also provided for securing the sheet 58 to underside 64 of the sleeping pad 52.

The inflatable pillow insert 54 consists of a sealed inflatable air chamber 66 and a hand pump 69 connected to side of the air chamber 66. When the pillow insert 54 is in position on the sleeping pad 52 the hand pump 69 can inflate the air chamber 66 manually.

The attachment device 62 consists of a plurality of male snaps 68 secured to ends 70 of the sheet 58 and a plurality of female snaps 72 secured to underside 64 of the sleeping pad 52 to mate with the male snaps 68 when the ends 70 of the sheet are pulled around the head portion 56 and foot portion 74 of the sleeping pad 52.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A sleeping bag sheet insert for fitting within a sleeping bag for preventing the inside of the sleeping bag from becoming soiled, said insert comprising:

(a) a foam rubber sleeping pad with head and feet ends, and top and bottom surfaces;

(b) an inflatable pillow insert placed on the head end of said sleeping pad;

(c) an elongated sheet to cover said sleeping pad and said pillow insert, said sheet being open at the portions of the sides over said pillow insert and having opposite ends which extend over the head and feet ends of the pad to positions underlying and engaging end portions of the top and bottom surfaces;

(d) means for securing said sheet to the underside of said sleeping pad; and (e) a hand pump connected to side of said inflatable pillow so that when said pillow is in position on said sleeping pad said hand pump can inflate said air chamber manually, wherein said means for securing said sheet to the bottom surface of said sleeping pad are a plurality of male snaps secured to said ends of said sheet and a plurality of female snaps secured to the bottom surface of said sleeping pad to mate with said make snaps when the ends of said sheet are pulled around the head and feet ends of said sleeping pad.

* * * * *